US007935225B2

(12) United States Patent
O'Brien et al.

(10) Patent No.: US 7,935,225 B2
(45) Date of Patent: May 3, 2011

(54) PAPERMAKER'S FORMING FABRICS INCLUDING MONOFILAMENTS COMPRISED OF A BLEND OF POLY(ETHYLENE NAPHTHALATE) AND POLY(ETHYLENE TEREPHTHALATE)

(75) Inventors: Timothy D. O'Brien, Williston, VT (US); Bryce Jones, Richmond, VT (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 12/919,797

(22) PCT Filed: Feb. 23, 2009

(86) PCT No.: PCT/US2009/034850

§ 371 (c)(1),
(2), (4) Date: Sep. 21, 2010

(87) PCT Pub. No.: WO2009/108597

PCT Pub. Date: Sep. 3, 2009

(65) Prior Publication Data

US 2011/0005700 A1 Jan. 13, 2011

Related U.S. Application Data

(60) Provisional application No. 61/031,813, filed on Feb. 27, 2008.

(51) Int. Cl.
*D21G 9/00* (2006.01)

(52) U.S. Cl. ..... 162/289; 162/358; 162/267; 442/189

(58) Field of Classification Search ..... 162/289, 162/358, 267, 348; 442/189, 187; 28/104
See application file for complete search history.

(56) References Cited

U.S. PATENT DOCUMENTS

| | | | |
|---|---|---|---|
| 5,158,117 | A | 10/1992 | Huhtiniemi |
| 5,405,685 | A | 4/1995 | Patel |
| 5,466,525 | A | 11/1995 | Maria et al. |
| 5,840,637 | A | 11/1998 | Denton et al. |
| 5,910,363 | A | 6/1999 | Rogers et al. |
| 5,955,196 | A | 9/1999 | Sakellerides |
| 6,136,437 | A | 10/2000 | Reither |
| 6,227,255 | B1 | 5/2001 | Osterberg et al. |
| 6,586,558 | B2 | 7/2003 | Schmidt et al. |
| 6,763,855 | B2 | 7/2004 | Rougvie |
| 6,790,796 | B2 | 9/2004 | Smith et al. |
| 6,905,574 | B2 | 6/2005 | Festor |

FOREIGN PATENT DOCUMENTS

| | | |
|---|---|---|
| WO | 9812367 | 3/1998 |
| WO | 9931316 | 6/1999 |
| WO | 03046277 | 6/2003 |
| WO | 03057977 | 7/2003 |
| WO | 2004048682 | 6/2004 |

*Primary Examiner* — Mark Halpern
(74) *Attorney, Agent, or Firm* — Volpe and Koenig, P.C.

(57) ABSTRACT

Papermaker's forming fabrics including extruded thermoplastic monofilaments formed from a polymer blend consisting of from about 51%-90% pbw (parts by weight) of a poly(ethylene naphthalate) (PEN) polymer having a melt point of from 249° C. to about 278° C., most preferably between about 262° C. and 273° C., and an intrinsic viscosity of from 0.45 to about 0.95, preferably from about 0.65 to about 0.85, along with from about 49%-10% pbw of a poly (ethylene terephthalate) (PET) polymer having an intrinsic viscosity of between about 0.55 to about 1.05, preferably from about 0.85 to 1.0. Monofilaments formed from the novel polymer blend exhibit physical properties differing from those obtained from monofilaments formed of 100% PEN polymer, making them particularly suitable for use in weaving and processing the forming fabrics of the present invention.

16 Claims, 2 Drawing Sheets

PAPERMAKER'S FORMING FABRICS INCLUDING MONOFILAMENTS COMPRISED OF A BLEND OF POLY(ETHYLENE NAPHTHALATE) AND POLY(ETHYLENE TEREPHTHALATE)

This application is a 371 of PCT/US09/34850 filed on 23 Feb. 2009.

FIELD OF THE INVENTION

The present invention concerns papermaker's forming fabrics including thermoplastic monofilaments extruded from a blend of poly(ethylene terephthalate) (PET) and poly(ethylene naphthalate) (PEN) polymers in which the ratio by weight of the PEN to the PET in the polymer blend from which the monofilaments are extruded is from about 51%-90% parts by weight poly(ethylene naphthalate) to about 49%-10% parts by weight poly(ethylene terephthalate); the melt point of the PEN used in the blend is from about 249° C. to about 278° C. and the intrinisic viscosity of the PEN is from about 0.65 to 0.85.

BACKGROUND OF THE INVENTION

Paper is made in a continuous process beginning in the forming section of a papermaking machine where a very dilute slurry consisting of about 99% water and 1% papermaking fibers is delivered at high speed from a headbox onto a moving forming fabric. Modern papermaking machines can be very wide, up to and exceeding about 400 inches (about 10 m) in width or more, and are capable of manufacturing paper product at speeds in excess of more than one mile per minute (1.6 km/min) at this width. The forming fabric, or fabrics in a so-called twin-wire papermaking machine, is/are intended to form the sheet, convey it through the forming section and allow for drainage of large volumes of fluid from the papermaking stock so that its consistency reaches about 25% papermaking fiber content at the end of the forming section. Drainage and sheet formation are enhanced by means of stationary foil blades, suction boxes and other devices which are located beneath and in sliding contact with the forming fabric or fabrics. High pressure showers are used to clean the fabric and assist in trimming the sheet. The very wet and loosely cohesive embryonic paper web is then transferred in a transfer process from the forming section to the press section where further water removal occurs by mechanical means as the sheet is pressed in a series of press nips while it is sandwiched between two press fabrics in each nip. Final water removal occurs in the dryer section where the web is further dried by evaporative means as it is transported over a number of heated drums while conveyed upon one or several dryer fabrics in succession.

It will be appreciated that the fabrics used in the papermaking process must be very rugged so as to withstand the abrasive wear, fabric tensions, elevated temperatures, and chemical environment to which they are exposed. In the forming section particularly, the fabrics are exposed to relatively high tensions and levels of wear as they move across and around various stationary fabric supporting elements and rolls while transporting a layer of papermaking stock. Forming fabrics must also possess a very fine, smooth papermaking surface structure so that the sheet that is formed and conveyed upon them is as uniform as possible and is devoid of any marking that could be imparted by the fabric and its seam.

Because of these various and competing requirements, it will be apparent that selection of both the fabric weave pattern and the component materials, particularly the monofilaments from which the fabrics are formed, is of great importance with respect to the stability, durability and papermaking utility of the fabric. Forming fabrics are currently woven using thermoplastic monofilaments with relatively small diameters. For example, circular monofilaments used in such fabrics will have diameters typically in the range of from about 0.10 mm to about 0.5 mm (0.039 to 0.193 in) and will be woven at mesh counts on their paper side surface (i.e. number of MD yarns per unit fabric width) of from about 30-40 up to about 90-110 yarns per inch (from about 12-16 up to about 35-43 yarns/cm). It is also known to use generally rectangular, square, oval and similar cross-sectional yarn shapes in forming fabrics.

Forming fabrics are often double layer woven structures designed to provide the requisite fine and smooth papermaking surface that is mounted upon a much more rugged, stable structure which, when in use, is in sliding contact with the stationary elements of the forming section. However single layer, triple layer and other similar constructions are known and used (see e.g. PAPTAC [Pulp and Paper Technical Association of Canada] Data Sheet G-18, Rev. May 2005, entitled "Weaves of Papermaking Wires and Forming Fabrics" for examples of other forming fabric weave structures in which the monofilaments of the present invention would be applicable).

The monofilaments from which forming fabrics are frequently formed are generally extruded from a thermoplastic polymeric material, commonly a polyester such as poly(ethylene terephthalate) or PET, poly(butylene terephthalate) or PBT, poly(ethylene naphthalate) or PEN, and the like. Various polyamides (e.g. nylon-6. nylon 6/12, etc.) and polymer blends (e.g. polyester-polyurethane) are also known and used to provide the fabrics with the requisite wear resistance, stability, strength and general durability. It is an important characteristic of the yarns employed in the manufacture of papermaker's forming fabrics that they possess physical properties amenable to weaving, heatsetting and similar processes employed in the formation of the textile.

In recent years, a number of polymeric materials have been developed and used with varying degrees of success in the construction of papermakers fabrics intended for the forming, press or dryer sections of the papermaking machine. These materials include, for example, various polyamides, polyphenylene sulfide (PPS), polyetheretherketone (PEEK), liquid crystal polymers (LCP), and numerous polymer blends that have been engineered so as to provide specific physical properties that would render them suitable for papermaking fabric applications. Of these various polymers, polyesters have proven to be the most successful materials for these applications due, in part, to their resistance to dimensional change, chemical degradation and abrasion, as well as their weaving and processing characteristics, all of which are factors important to maximize the wear life and overall quality of papermaking fabrics.

Recently, it has been proposed to use yarns formed from poly(ethylene naphthalate), or PEN, in papermachine fabrics, in particular as the warp yarn material which is oriented in the length or machine direction of the fabric, due to its high modulus and other desirable physical properties. Modulus, also referred to as elastic modulus and expressed in pounds per linear inch (or kg/mm$^2$), generally refers to the resistance of a yarn or fabric to stretch or distortion under tension. Papermakers forming fabrics must be stretch resistant, and have a relatively high tensile strength so as to resist catastrophic failure due to the tensions caused by the drag load and other frictional forces to which they are exposed. Forming fabrics intended for the production of kraft and similar high basis weight brown paper grades must have a higher tensile strength than fabrics intended for the manufacture of tissue (lighter basis weight) products due to the dewatering and formation forces to which each product is exposed. However, regardless of the grade of paper for which the fabric is intended, manufacturers of forming fabrics will strive to employ yarns which have a high tensile strength and elastic modulus and are thus resistant to stretch. PEN is a good candidate material because it is known to be resistant to elastic distortion and also possesses good tensile strength characteristics.

However, there are various problems associated with the use of monofilaments comprised of 100% PEN polymer (also referred to as "pure" PEN) in the manufacture of forming fabrics. For example, it is difficult to reliably extrude this material in monofilament form to provide a yarn product having acceptable diameter variation along its length. Strand diameter variations will cause problems with forming fabrics, including non-uniform drainage of the papermaking slurry, non-uniformities in the paper product being formed, irregularities in the tensile strength of the fabric, and so on. Another problem that has been observed in monofilaments formed from PEN relates to what is referred to as "notch sensitivity". The term notch sensitivity means that surface imperfections, such as dents or scratches or similar surface deformities, will quickly propagate and cause yarn breakages while under tension, making such monofilaments particularly difficult to weave on modern high speed looms. In addition, the material is difficult to process and special fabric processing parameters (such as heatsetting temperatures, dwell times and tensions) must be used because PEN yarns are usually highly oriented (stretched) to provide their correspondingly high elastic modulus strength. This makes the PEN monofilaments difficult to crimp when interwoven with a relatively softer weft material. Fabrics containing pure PEN monofilaments as warp materials must be heatset for longer periods than fabrics woven using other polyesters such as PET. This lengthy processing is further exacerbated due to the comparatively lower force of shrinkage (FOS) generated by pure PEN monofilament as compared to PET polyester, for example. Force of shrinkage relates to the tendency of a yarn to shrink during application of heat, such as in a fabric heatsetting process. Due to the low FOS of pure PEN monofilaments, fabrics containing these yarns must be stretched to a greater degree in the heatsetting process than fabrics made from PET polyester monofilament yarns so as to transfer crimp to the cross-machine direction weft yarns and develop acceptable fabric properties. In addition the cost per unit weight of the PEN polymer resin from which the monofilaments are formed is generally higher than that of a comparable PET resin, making woven products formed from the PEN resin more expensive to produce.

Due to these various problems, and other known deficiencies of fabrics and monofilaments formed from pure or known blends of PEN, it would be highly desirable if a thermoplastic monofilament were available for use in papermakers fabrics which monofilament was dimensionally stable over a wide range of environmental conditions, provided sufficient levels of abrasion resistance so as to enhance the longevity of the fabric, offered good weaving properties so that it could be incorporated into the fabric structure, provided sufficiently high elastic modulus to impart stretch resistance to the fabric, could be reliably extruded with the required shapes and dimensions, was capable of being processed in a fabric at temperatures and tensions similar to PET, and which was available at a reasonable price.

BRIEF DISCUSSION OF PRIOR ART

The prior art is replete with disclosures of monofilaments formed from PEN, as well as those describing the use of certain PEN monofilament structures in papermakers fabrics.

U.S. Pat. No. 5,466,525 (Maria et al.) discloses the production of multifilament yarns, monofilaments and films for technical application, which yarns and films consist of at least 70% by weight of a polyethylene naphthalate which is preferably polyethylene-2,6-naphthalate. The polymer can contain other monomers, and has a DSC melting point of 292° C. to 312° C. when measured on a sample quantity of 2.5 mg at a heating rate of 20° C. The multifilament yarns, monofilament or films also exhibit hot air shrinkage of less than 3.5% (preferably less than 2.5% and more preferably less than 1.6%) when measured after heating for 15 minutes at 190° C. Various other properties of the yarns and film are disclosed.

U.S. Pat. No. 5,955,196 (Sakellerides) discloses an extruded polyester fiber containing aromatic ester units of at least terephthalate and 2,6-naphthalate wherein the 2,6-naphthalate units comprise about 12 to about 50 mole percent (mole %) of the aromatic ester units in the polyester. The fiber allegedly has high shrink properties making it useful in applications where crimp retention or high bulk is desirable, such as carpet yarns, high-loft nonwovens for interlinings and the like, as well as in specialty yarns for weaving and knitting.

Use of pure or blended PEN filaments and yarns in papermaking and related fabrics is disclosed in the following patents and patent applications: U.S. Pat. No. 5,405,685 (Patel), U.S. Pat. No. 5,840,637 (Denton et al.), U.S. Pat. No. 6,905,574 (Festor), U.S. Pat. No. 6,227,255 (Osterberg et al.), WO 03/046277 (Johnson et al.), U.S. Pat. No. 6,136,437 (Reither), WO 03/057977 (Patel et al.), WO 99/031316 (Osterberg et al.), and WO 04/048682 (Hay et al.). Others are known.

In addition, U.S. Pat. No. 5,910,363 (Rogers et al.) discloses components, including monofilaments and films, formed from a composition comprised of 95-99% polyester comprised of 85-100 mole % 2,6-naphthalenedicarboxylic acid and 85-100 mole % of at least one aliphatic glycol, and from 0.1-5 wt % of a carbodiimide. The monofilaments are allegedly hydrolysis resistant. Also, WO 98/012367 discloses the use of monofilaments formed of postcondensed PEN having a DSC melting point that is less than 290° C. in technical fabrics for use in printing and filtration.

SUMMARY

The present inventors have discovered that thermoplastic monofilament, extruded from a polymer blend of PET polyester and PEN polyethylene naphthalate polyester, having the disclosed intrinsic viscosities and melt points, and which are combined in the blend in an appropriate ratio of parts by weight, can provide woven papermaking fabrics with the degree of stability, uniformity, weaving and processing properties, and other physical properties that are required by papermakers and manufacturers of papermaking fabrics.

The present invention is a woven papermaker's forming fabric comprised of extruded thermoplastic monofilaments as each of the warp and weft components, wherein at least a portion of the monofilaments are formed from a polymer blend consisting of:

a. from 51% to 90% pbw (parts by weight) of a poly (ethylene naphthalate) (PEN) polyester whose melt point is between 249° and 278° C. and whose intrinsic viscosity when measured according to ASTM D4603-86 using phenol/1,1,2,2 tetrachloroethane solution at 30° C. is between 0.65 and 0.85, and b. from 49% to 10% pbw of a poly(ethylene terephthalate) (PET) polyester whose intrinsic viscosity when measured according to ASTM D4603-86 using phenol/1,1,2,2 tetrachloroethane solution at 30° C. is between 0.55 and 1.05.

Preferably, the parts by weight ratio of PEN to PET in the polymer blend from which the monofilaments used in the fabrics of the invention are formed is from about 51% to about 90% pbw of poly(ethylene naphthalate) to from about 49%-10% pbw poly(ethylene terephthalate). More preferably, this ratio is from about 65%-85% pbw PEN to from 35%-15% pbw PET. Most preferably, the ratio of the PEN to the PET is about 85% pbw PEN to about 15% pbw PET.

It is presently preferred that the melting point of the poly (ethylene naphthalate) be in the range of from about 249° C. to about 278° C. More preferably, the melt point of the PEN is between about 260° C. and 275° C. Most preferably the melt point of the PEN is between about 262° C. and 273° C. Satisfactory results have been obtained when using PEN whose melt point is in this range.

Melt point is determined by Differential Scanning Calorimetry (DSC). To determine melt point, a sample of material, of known weight, is placed in a gradually increasing temperature environment and the heat flow difference between the sample and reference is plotted vs temperature. The minimum of the thermograph (negative peak) is defined as the melt point and the area within the peak is the energy required to melt the sample. The heating rate used to determine melt point by DSC in this invention is 20° C./minute.

Preferably, the intrinsic viscosity (IV) of the PEN used in the polymer blend from which the monofilaments used in the fabrics of the invention are made is from 0.45 to about 0.95. A preferred range for the IV of the PEN used in the manufacture of the monofilaments used in the fabrics of this invention is from 0.65 to 0.85. Most preferably the PEN has an IV of about 0.75.

Preferably, the PET incorporated in the polymer blend from which the monofilaments used in the fabrics of the present invention are formed should have an IV that is in the range of from about 0.55 to about 1.05. More preferably, the range of the IV of the PET is from 0.85 to 1.0. Most preferably, the IV of the PET is about 0.95.

Intrinsic viscosity, or IV, as used herein, is determined according to the method described in ASTM D4603-86 using phenol/1,1,2,2 tetrachloroethane solution at 30° C. Intrinsic viscosity is independent of concentration by virtue of extrapolation to zero concentration, but is a function of the solvent used, and temperature.

While being at least equivalent in physical properties, such as elastic modulus, to monofilaments formed from pure PEN, yarns formed from the polymer blend of this invention offer a number of advantages when compared to monofilaments formed of pure (unblended) PET or PEN:

1. they are more economical to produce than comparable monofilaments comprised of pure or unblended PEN, and thus offer a cost savings;
2. they can be woven using loom and related settings in a manner similar to yarns formed from pure PET polymer;
3. fabrics containing the novel yarns provide better properties following a heatsetting process (for example, yarn crimp retention and exchange) than fabrics containing pure PEN so that the resulting fabric is more stretch resistant than similar fabrics formed from pure PET;
4. fabrics formed from the yarns of the polymer blend of this invention are comparatively easier to heatset to obtain desired yarn crimp and fabric stability than fabrics formed from yarns comprised of pure PEN;
5. the novel yarns are less prone to fracture and breakage on the loom than comparable monofilaments formed from pure PEN; and
6. yarns formed from the polymer blend offer improvements in various physical properties important in papermakers fabrics, including abrasion resistance, diameter uniformity, tensile strength (as well as knot tensile and loop tensile strength), and provide improved resistance to high pressure shower damage when compared to monofilaments comprised of pure PEN.

BRIEF DESCRIPTION OF THE DRAWINGS

The invention will be better understood when read in conjunction with the attached drawings, in which.

DETAILED DESCRIPTION OF THE PREFERRED EMBODIMENTS

The papermakers forming fabrics of the present invention can be of any desired weave design or fabric structure, including single layer, double layer, layer and one-half, triple layer, and both warp and weft tied composite structures. Examples of fabric structures that may benefit from the use of these monofilaments include single layer forming fabrics such as are disclosed in U.S. Pat. No. 5,799,707 (Barrett et al.), double layer fabrics such as are disclosed in U.S. Pat. No. 5,421,374, U.S. Pat. No. 5,564,475, U.S. Pat. No. 6,413,377 (all to Wright) and U.S. Pat. No. 6,989,079 (Johnson et al.); weft tied composite forming fabrics such as are disclosed in U.S. Pat. No. 5,544,678 (Barrett), U.S. Pat. No. 5,826,627 (Seabrook et al.), U.S. Pat. No. 6,334,467 (Barrett et al.) and U.S. Pat. No. 6,810,917 (Stone); warp tied composite structures such as are described in U.S. Pat. No. 6,202,705 (Johnson et al.), U.S. Pat. No. 6,240,973 (Stone et al.), U.S. Pat. No. 6,581,645 (Johnson et al.), U.S. Pat. No. 7,108,020 (Stone) and WO 06/034576 (Danby et al.); and through-air dryer fabrics such as are disclosed in U.S. Pat. No. 7,114,529 (Johnson et al.), all of which are incorporated by reference herein as if fully set forth. Other fabric structures and designs such as those illustrated and described in PAPTAC Data Sheet G-18, Rev. May 2005, entitled "Weaves of Papermaking Wires and Forming Fabrics", which is incorporated herein as if fully set forth, may likewise benefit from the teachings of this invention.

Monofilament Manufacture

Monofilaments made in accordance with the teachings of the invention and which were suitable for use in forming fabric manufacture were produced in the following manner. Pellets of PEN resin and PET resin were first obtained. The PEN material used in the monofilaments of this invention was Futura Polymers Ltd. of Tamil Nadu, India, type 7001, having an intrinsic viscosity (IV) of from 0.45 to about 0.95. A preferred range of IV for the PEN used in the manufacture of the monofilaments of this invention is from 0.65 to 0.85. Most preferably the PEN has an IV of about 0.75. The melt point of the PEN material should be in the range of from about 249° C. to about 278° C. and is preferably between about 262° C. to 273° C. as determined by DSC at a heating rate of 20° C. per minute.

Intrinsic viscosity, or IV, as used herein is determined according to the method described in ASTM D4603-86, which is incorporated by reference herein as if fully set forth, using phenol/1,1,2,2 tetrachloroethane solution at 30° C.

Figure 1:
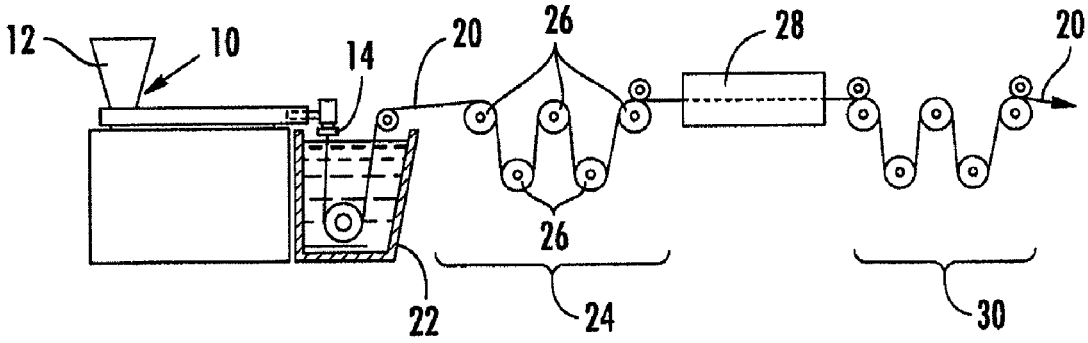
FIG. 1 is a view of a monofilament extruding arrangement for extruding monofilaments in accordance with the invention.

The pellets of PEN resin were volumetrically mixed at the throat 12 of the extruder 10, shown in FIG. 1, in a ratio of from 69% to 84% pbw PEN polyester with from 31%-16% pbw PET polyester. The PET resin used in the monofilaments of the invention was Du Pont Merge 5149 PET available from E. I. du Pont de Nemours and Company of Wilmington, Del. To provide monofilaments 20 suitable for use in the fabrics of this invention, the PET should have an IV that is in the range of from about 0.55 to about 1.05, with a preferred range of IV of from 0.85 to 1.0. Preferably the IV of the PET is about 0.95. Additives, such as titanium dioxide, dyes, and processing aids such as lubricants and the like, may also be added as necessary but do not form part of this invention. The resulting monofilament is transparent and may benefit from addition of a colorant to assist with seaming and other automated textile processes employed in the assembly of papermaker's forming fabrics.

Although successful results have been obtained using a single screw extruder 10, twin screw extrusion may provide more intimate mixing of the blend components. The extruder temperature at the die 14, collar and pump zones should be between 560-610° F. (293-321° C.), extrusion temperatures which would be appropriate for pure PEN monofilament, but which are higher than required for a PET monofilament. Preferably, the extruder temperature in these zones is between 590 and 610° F. (310-321° C.). We have found that, if the extruder temperature in this area is below this range, then the exterior surface of the resulting monofilament may be roughened during extrusion (referred to as "shark skinning") and the monofilament 20 may not be acceptable for use in a forming fabric.

The monofilament 20 is extruded from the die 14 into a water quench 22 and from there is wicked and proceeds to a first godet 24, having a plurality of rolls 26. A single, double or three stage draw may be employed as appropriate for the intended end use. A common arrangement is to pass the monofilament extrudate from a first godet 24 to a first hot air stretch oven 28, to a second godet (not shown) and oven (not shown), to a third godet (not shown) and oven (not shown) and a final godet 30. Those skilled in the art will recognize that the second godet and oven as well as the third godet and oven would have a similar or generally the same arrangement as the first godet 24 and oven 28 in FIG. 1, and may or may not be required, depending on the particular process and extrusion arrangement.

A relaxation stage of from 0% to 8%, preferably from 2% to 6% and more preferably in the range of from 4% to 6% may be employed in between one or more draws, or following the stretch process. The overall draw ratio should be between 5.5:1 and 7.2:1. Preferably the draw ratio is between 6.2:1 and 7.2:1. We have found that a high initial draw is particularly effective as this appears to increase both the elastic modulus and tensile strength of the finished monofilament.

An antistatic treatment and lubricant may be applied to the monofilament prior to winding on spools. The finished product is then ready for use in the weaving of forming fabrics.

Table 3 provides a comparison between the properties of a 0.17 mm diameter monofilament comprised of 100% PEN and a similar sized and shaped monofilament made according to the polymer blend of the invention. In this table, the PEN was Futura Type 7001-C available from Futura Polymers, a division of Futura Polyesters, Ltd. of Tamil Nadu, India having an IV of 0.75. The "experimental" monofilament was made from a blend of 85% pbw Futura Type 7001-C PEN having an IV of 0.75 that was volumetrically fed at the extruder throat with 15% pbw DuPont Merge 5149 PET with an IV of 0.95; the PET was fed into the primary PEN feedstock.

Tables 1 and 2 below summarize the extrusion conditions used to produce 0.17 mm diameter circular cross-section monofilament comprised of 100% PEN and the experimental monofilaments comprised of the indicated polymer blend. Table 3 below summarizes the physical properties of the resulting two monofilaments.

TABLE 1

Extrusion Conditions — Extrusion Temperatures

| Extruder Zone | Extrusion Temperature (° F./° C.) 100% PEN | Extrusion Temperature (° F./° C.) Experimental (85% PEN + 15% PET) |
|---|---|---|
| Zone 1 | 570/299 | 570/299 |
| Zone 2 | 585/307 | 585/307 |
| Zone 3 | 585/307 | 585/307 |
| Zone 4 | 585/307 | 585/307 |
| Collar & adapter | 600/316 | 595/313 |
| Spin Pump | 600/316 | 595/313 |
| Head | 600/316 | 595/313 |

TABLE 2

Extrusion Conditions — Draw and Relaxation

| Extrusion Parameter | 100% PEN | Experimental (85% PEN + 15% PET) |
|---|---|---|
| Draw Ratio | 6.05:1 | 6.3:1 |
| Relaxation (%) | 5.4% | 2.5% |
| Oven Temperature (° F./° C.) | 380/193 | 325/163 |

TABLE 3

Comparison of 100% PEN Monofilament Properties to Experimental (85% PEN + 15% PET)

| | | Monofilament | |
|---|---|---|---|
| Monofilament Property | Units | 100% PEN | Experimental |
| Diameter | (mm) | 0.170 | 0.169 |
| In-Line | (mm) | 0.0025 | 0.0024 |
| Yield Point | ($Kg/mm^2$) | 17.6 | 16.7 |
| Tensile @ Break | ($Kg/mm^2$) | 77.0 | 87.7 |
| Elongation @ Break | (%) | 14.3 | 12.3 |
| Elastic Modulus | ($Kg/mm^2$) | 2334 | 2333 |
| 200° C. Annealed Modulus | ($Kg/mm^2$) | 2620 | 2535 |
| Shrinkage @ 200° C. | (%) | 4.3 | 11.5 |
| Knot Tensile | ($Kg/mm^2$) | 50.7 | 57.7 |
| Knot Elongation | (%) | 7.0 | 6.4 |
| Loop Tensile | ($Kg/mm^2$) | 68.7 | 84.7 |
| Loop Elongation | (%) | 3.4 | 3.8 |
| RTPS | (%) | 4.87 | 4.59 |

Table 3 above summarizes various physical properties of 0.17 mm diameter monofilaments comprised of 100% Futura Type 7001-C PEN having an IV of 0.75 as compared to similar monofilaments comprised of a blend of 85% pbw Futura Type 7001-C PEN having an IV of 0.75 with 15% pbw DuPont Merge 5149 PET with an IV of 0.95. In Table 3, the following terms have the meanings indicated:

a. "In-line" refers to the average diameter variation along the axis of the extruded monofilament as extruded;
b. "Yield Point" provides an indication of the ability to crimp the monofilament during weaving; the lower the yield point, the easier it is to crimp the yarn. This is an important feature when the intended use of the monofilament is in an industrial textile;
c. "Tensile @ Break" is an indication of the strength of the yarn which, when woven into a fabric, would be indicative of the fabric's resistance to damage and from being torn off the papermaking machine.
d. "Elongation @ Break" is a monofilament property related to tensile strength; in this case, the experimental monofilament has a higher tensile @ break than the pure PEN monofilament, and a smaller elongation.
e. "Elastic Modulus" refers to the resistance of the monofilament to stretch.
f. "200° C. Annealed Modulus" is the elastic modulus of the strand after exposure to 200° C. under tension and has a strong correlation to the ability to heatset the textile following weaving to stabilize it. It is also indicative of the stretch resistance of the fabric when used on the papermaking machine.
g. "Shrinkage @ 200° C." gives an indication of the orientation of the molecules in the axial direction of the yarn; highly oriented molecules will have a greater tendency to shrink than less oriented molecules. In this case, the experimental material appears to exhibit a greater tendency to shrinkage than the 100% PEN monofilament.
h. "Knot Tensile" and "Loop Tensile" are closely related terms providing an indication of the durability of the strand during weaving; the higher the knot or loop tensile, the fewer yarn breaks that will occur during weaving.
i. "Knot Elongation" and "Loop Elongation" refer to the strain to failure of either a knot or loop,
j. "RTPS", or "Room Temperature Permanent Set" also refers to the ease of crimping the yarn and imparting a permanent deformation in the strand.

The yarn properties provided in Table 3 indicate that yarns formed from the polymer blend of this invention will weave more easily than yarns formed from 100% PEN (due to the lower yield point and lower RTPS) as compared to similar monofilaments made from 100% PEN.

Fabric Manufacture

Figure 2:
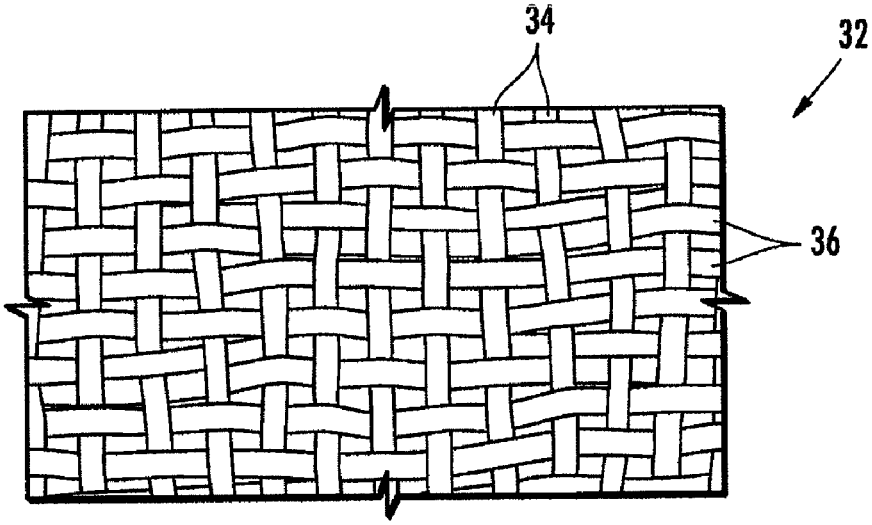
FIG. 2 is a plan view of a top surface of a forming fabric type that can be woven with the monofilaments according to the invention.
Figure 3:
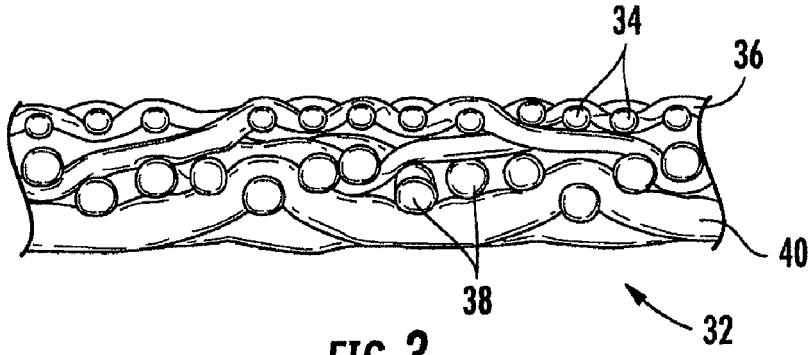
FIG. 3 is a cross direction, cross-sectional view of the fabric of FIG. 2.
Figure 4:
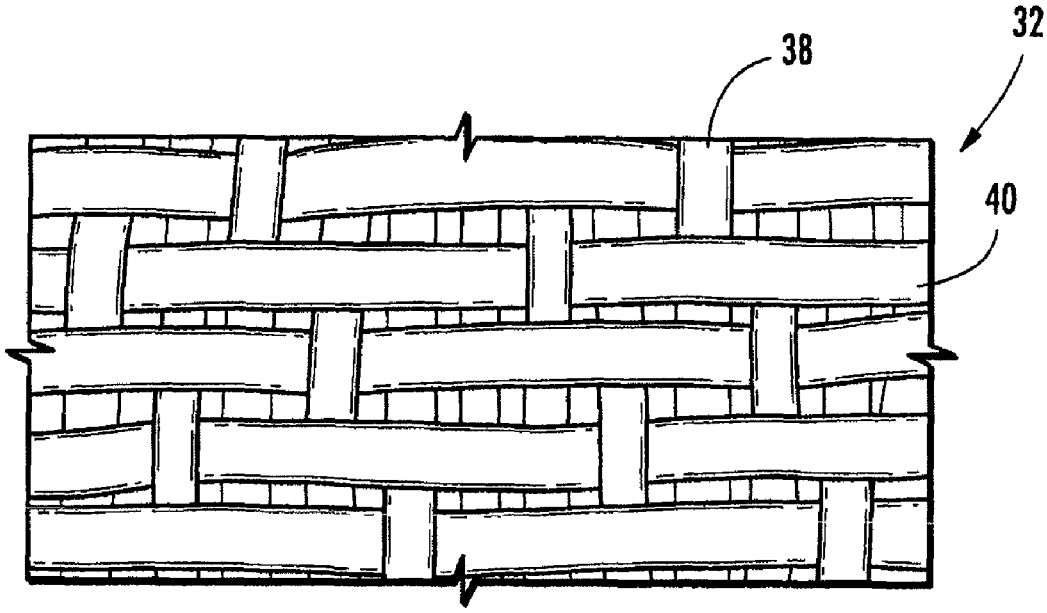
FIG. 4 is a bottom plan view of a machine side surface of the fabric of FIG. 2.
Figure 5:
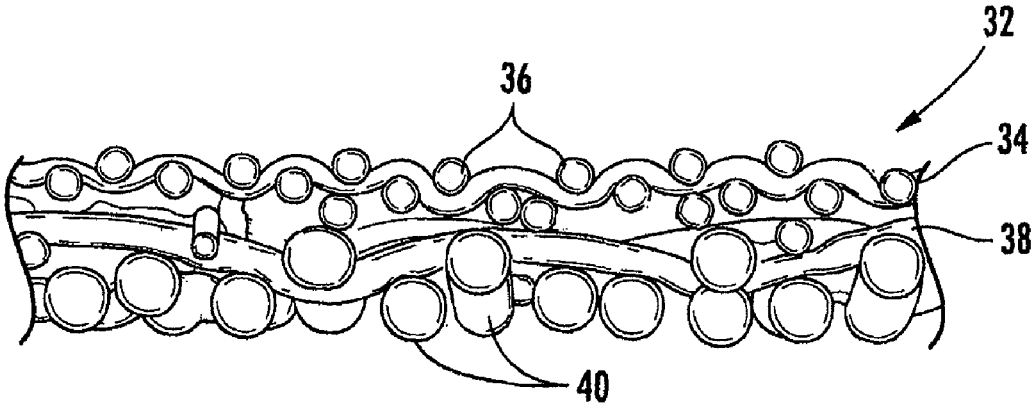
FIG. 5 is a machine direction, cross-sectional view of the fabric of FIG. 2.

Referring to FIGS. 2-5, a forming fabric 32 manufactured with the monofilaments according to the present invention is shown. Forming fabric 32 is a triple layer sheet support binder or intrinsic weft fabric, and in the illustrated embodiment is a 24-harness construction having a plain weave top formed from interwoven warp and weft monofilaments 34, 36, as shown in FIG. 2, and a 6-harness bottom weave formed from warp and weft monofilaments 38, 40, as shown in FIG. 4. Those skilled in the art will understand that the top and machine side fabric layers are inter-connected via intrinsic weft binders 36 that extend from the top surface into the machine side surface where they engage machine side warp yarns 38. FIG. 3 shows a cross-direction fabric 32 where an intrinsic weft binder 36 is illustrated. FIG. 5 shows a machine direction, cross-sectional view of the fabric 32. At least a portion of the monofilaments 34, 36, 38, 40 used to make the fabric 32 are produced in accordance with the invention, as described above, and correspond to the monofilament 20 except for the specific sizes utilized weaving the fabric 32. The portion of the fabric 32 produced from the monofilaments according to the invention could be some or all of the top surface warp yarns 34, some or all of the top surface weft yarns 36, some or all of the machine side warp yarns 38, some or all of the machine side weft yarns 40, or combinations of some or all of the above.

While the fabric 32 is one preferred embodiment, those skilled in the art will recognize that the monofilaments 20 according to the invention can be manufactured in various sizes and shapes and can be woven using conventional weaving equipment in various weave patterns into forming fabrics and/or TAD (through-air dryer) fabrics using monofilaments according to the invention.

While the preferred embodiments of the invention have been described in detail, the invention is not limited to the specific embodiments described above, which should be considered as merely exemplary. Further modifications and extensions of the present invention may be developed and all such modifications are deemed to be within the scope of the present invention as defined by the appended claims.

The invention claimed is:

1. A woven papermaker's forming fabric comprising extruded thermoplastic monofilaments as each of the warp and weft components, wherein at least a portion of the monofilaments are formed from a polymer that is a physical blend consisting of a. from 51% to 90% pbw (parts by weight) of a poly (ethylene naphthalate) (PEN) polyester whose melt point as determined by Differential Scanning Calorimetry is between 249° and 278° C. at a heating rate of 20° C./minute and whose intrinsic viscosity when measured according to ASTM D4603-86 using phenol/1,1,2,2 tetrachloroethane solution at 30° C. is between 0.65 and 0.85, and
b. from 49% to 10% pbw of a poly(ethylene terephthalate) (PET) whose intrinsic viscosity when measured according to ASTM D4603-86 using phenol/1,1,2,2 tetrachloroethane solution at 30° C. is between 0.55 and 1.05.

2. A fabric according to claim 1, wherein the amount of PEN in the blend is between 65% and 85% pbw, and the amount of PET in the blend is between 35% and 15% pbw.

3. A fabric according to claim 2, wherein the amount of PEN in the blend is between 80% and 85% pbw, and the amount of PET in the blend is between 20% and 15% pbw.

4. A fabric according to claim 1, wherein a melt point of the PEN is between 249° C. and 278° C.

5. A fabric according to claim 4, wherein the melt point of the PEN is between 260° C. and 275° C.

6. A fabric according to claim 5, wherein the melt point of the PEN is between 262° C. and 273° C.

7. A fabric according to claim 1, wherein the intrinsic viscosity of the PEN is between 0.65 and 0.85.

8. A fabric according to claim 7, wherein the intrinsic viscosity of the PEN is about 0.75.

9. A fabric according to claim 8, wherein the intrinsic viscosity of the PET is about 0.95.

10. A fabric according to claim 1, wherein the intrinsic viscosity of the PET is between 0.85 and 1.0.

11. A fabric according to claim 1, wherein the portion of the monofilaments formed from the blend are the warp components.

12. A fabric according to claim 1, wherein the portion of the monofilaments formed from the blend are the weft components.

13. A fabric according to claim 1, wherein the portion of the monofilaments formed from the blend are both the warp and weft components.

14. A fabric according to claim 13, wherein the fabric has two systems of warp yarns, and one or both systems are comprised of monofilaments formed from the blend.

15. A fabric according to claim 1, wherein the woven fabric structure is selected from the group consisting of: single layer woven structures, double layer woven structures, triple layer woven structures, layer and one-half woven structures, composite woven structures, weft tied woven structures, or warp tied woven structures.

16. A fabric according to claim 1, wherein the fabric is a through-air dryer fabric.

* * * * *